US005953878A

United States Patent [19]

Johnson

[11] Patent Number: 5,953,878

[45] Date of Patent: Sep. 21, 1999

[54] POLYVINYL DECK

[75] Inventor: Stephen A. Johnson, South Bend, Ind.

[73] Assignee: S.S.D. Control Technology, Inc., South Bend, Ind.

[21] Appl. No.: 08/870,922

[22] Filed: Jun. 6, 1997

[51] Int. Cl.[6] ..... E04B 5/02

[52] U.S. Cl. ..... 52/582.2; 52/582.1; 52/584.1; 52/489.1; 52/509; 403/397; 403/384; 403/326; 256/22; 256/19; 256/66

[58] Field of Search ..... 52/582.1, 582.2, 52/584.1, 489.1, 480, 650.3, 508, 509, 512; 403/397, 384, 326; 256/22, 19, 66

[56] References Cited

U.S. PATENT DOCUMENTS

| | | | |
|---|---|---|---|
| 1,375,043 | 4/1921 | Finlayson | 52/508 |
| 1,714,738 | 5/1929 | Smith | 52/512 |
| 2,137,508 | 11/1938 | Powell | 52/512 |
| 2,182,523 | 12/1939 | Markowski | 52/512 |
| 2,206,464 | 7/1940 | Lawrence | 52/512 |
| 2,377,211 | 5/1945 | Cocken, Jr. | 52/512 |
| 2,382,761 | 8/1945 | Wilks | 52/513 |
| 3,267,630 | 8/1966 | Omholt | 52/480 |
| 3,577,694 | 5/1971 | Omholt | 52/509 |
| 4,703,601 | 11/1987 | Abendroth | 52/509 |
| 5,209,896 | 5/1993 | Lipa et al. | 52/509 |
| 5,642,592 | 7/1997 | Andres | 52/650.3 |
| 5,660,016 | 8/1997 | Erwin et al. | 52/480 X |
| 5,826,382 | 10/1998 | Elsasser et al. | 52/181 |

*Primary Examiner*—Carl D. Friedman
*Assistant Examiner*—Phi Dieu Tran A
*Attorney, Agent, or Firm*—Baker & Daniels

[57] ABSTRACT

A polyvinyl floor or decking system for use on indoor and/or outdoor applications, including porches, decks, patios and marine docks. The system comprises a plurality of extruded, generally hollow elongated polyvinyl or plastic tubular members which are placed on a supporting frame or structure in a conventional manner. Each of the members includes a plurality of grooves on the top surface in order to maximize surface friction and provide a better walking surface in all conditions, and further includes a bottom surface, and a pair of side surfaces. Each of the side surfaces includes a plurality of slots that are spaced so as to generally overlie the supporting joists. A plurality of mounting cleats engage the slots on adjacent members, and secures the members to the deck and to each other. The cleat in slot arrangement allows for the different rates of thermal expansion and retraction of the polyvinyl deck members compared to the supporting wood frame.

9 Claims, 4 Drawing Sheets

POLYVINYL DECK

The present invention relates generally to a polyvinyl decking system for use on porches, decks, marine docks, and other applications.

BACKGROUND AND SUMMARY OF THE INVENTION

Polyvinyl building and construction materials are increasing in popularity due to their light weight, which greatly simplifies shipping, handling and installation, and also due to their durability in adverse weather conditions, which greatly increases their service life. Polyvinyl materials do not need to be periodically painted or preserved, which greatly lowers maintenance costs, and modern Ultra-Violet inhibitors prevent UV breakdown of polyvinyl materials for many years. However, in order to be cost competitive with wood and other traditional construction materials, and in order to have the needed strength and stiffness properties, such polyvinyl materials typically must be extruded as hollow tubular members. Extruded members are cheaper and easier to mass produce than are conventional molded members, and extruded members can be easily formed with internal reinforcing ribs or webs to add strength and stiffness. As such, the hollow extruded members offer a long lasting, low maintenance, and cost effective alternative for traditional wood floor members, such as on decks, floors, porches, marine docks and similar applications.

Unfortunately, the polyvinyl floor or decking members cannot be nailed or otherwise assembled according to traditional construction methods, because nails or screws driven directly through the plastic are likely to cause stress risers and/or cracking. Therefore, the hollow extruded members require special mounting brackets or cleats in order to secure the members to the supporting frame or structure.

On most existing polyvinyl decking systems, the decking members have a series of openings in the bottom surface, and the members are snapped onto mounting brackets or clips that have been attached to the top of the joist or support structure. Another prior art approach utilizes U-shaped mounting clips that are attached to the top of the joist. The decking members are secured to the upwardly extending legs of the mounting clip. Such prior art systems have a number of drawbacks, including relatively high material costs and relatively long installation time, and on many such systems it is difficult to properly align the holes in the deck members with the pre-installed clips. Moreover, if the pre-installed clips are not mounted properly the decking members may move or "wander" slightly, giving the deck an unsightly and unprofessional appearance.

Another drawback with prior art methods is that polyvinyl, like all construction materials, flexes slightly under load. On conventional wood decks such flexing is almost completely unnoticeable. However, on plastic or polyvinyl decks such flexing often creates an unnerving and unpleasant squeak or creaking sound. For many reasons, most consumers consider such squeaking and creaking a very undesirable attribute. Accordingly, there exists a need for an improved polyvinyl decking system that is cost effective to produce and install, and that does not have any of the unfavorable characteristics that plague prior art polyvinyl decking systems.

The present invention utilizes extruded tubular decking members that have internal reinforcing webs to maximize flexural strength and stiffness. The present invention also utilizes a unique mounting bracket or cleat that fits between adjacent decking members and maintains the proper spacing between deck members and also secures the deck members to each other and to the supporting joists. In order to reduce or even eliminate squeaking, the cleat is formed of hardened acetone. Also, because the wood joists and the plastic deck have very different thermal expansion coefficients, the cleat includes a longitudinal expansion slot that eliminates binding or buckling that could results from the expansion and contraction of the finished structure due to temperature changes.

Each deck member includes a first side that is secured to the supporting joists by the cleat, and a second side that engages the cleat on the first side of the preceding adjacent member. Both sides of each deck members include a series of horizontal slots that engage the cleats, and the slots are spaced to match the distance between the supporting joists. The cleats are located between adjacent deck members, and secure the deck members to the joists and to each other. Each cleat includes a pair of oppositely facing protrusions that fit into the slots in the sides of the adjacent deck members. The protrusion on one side of the cleat is sized to snap tightly into the slot on the first side of each member, while the second smaller protrusion on the other side fits into but is slightly smaller than the slot on the second side of the next adjacent member, leaving a small gap between the sides of the protrusion and the ends of the slot. Thus, the installer has some degree of flexibility when installing each member, which eliminates the progressive wander referred to above.

To assemble the deck, the installer snaps the cleat into the slot on the first side of a member, and then secures the member in place by connecting the cleat to the joist by fastening a screw or nail through the slotted expansion hole. The installer then places the second side of the subsequent adjacent member next to the first side of the installed preceding member, so that the second protrusion of the installed cleat engages the slot in the second side of the subsequent member. The cleat in the slot on the first side of the subsequent member is then secured to the joist. The process is then repeated with each subsequent member.

Accordingly, it is an object of this invention to provide an improved polyvinyl or plastic deck system.

It is another object of this invention to provide a polyvinyl or plastic deck that can be installed faster and more efficiently than prior art decks.

A further object of this invention is to provide a polyvinyl or plastic deck that eliminates binding or buckling cause by unequal thermal expansion.

A still further object of this invention is to provide a polyvinyl or plastic deck that does not squeak.

These and other objects of the invention will become apparent to those skilled in the art upon a reading of the following description, with reference to the accompanying drawings.

DETAILED DESCRIPTION OF THE INVENTION

Figure 1:
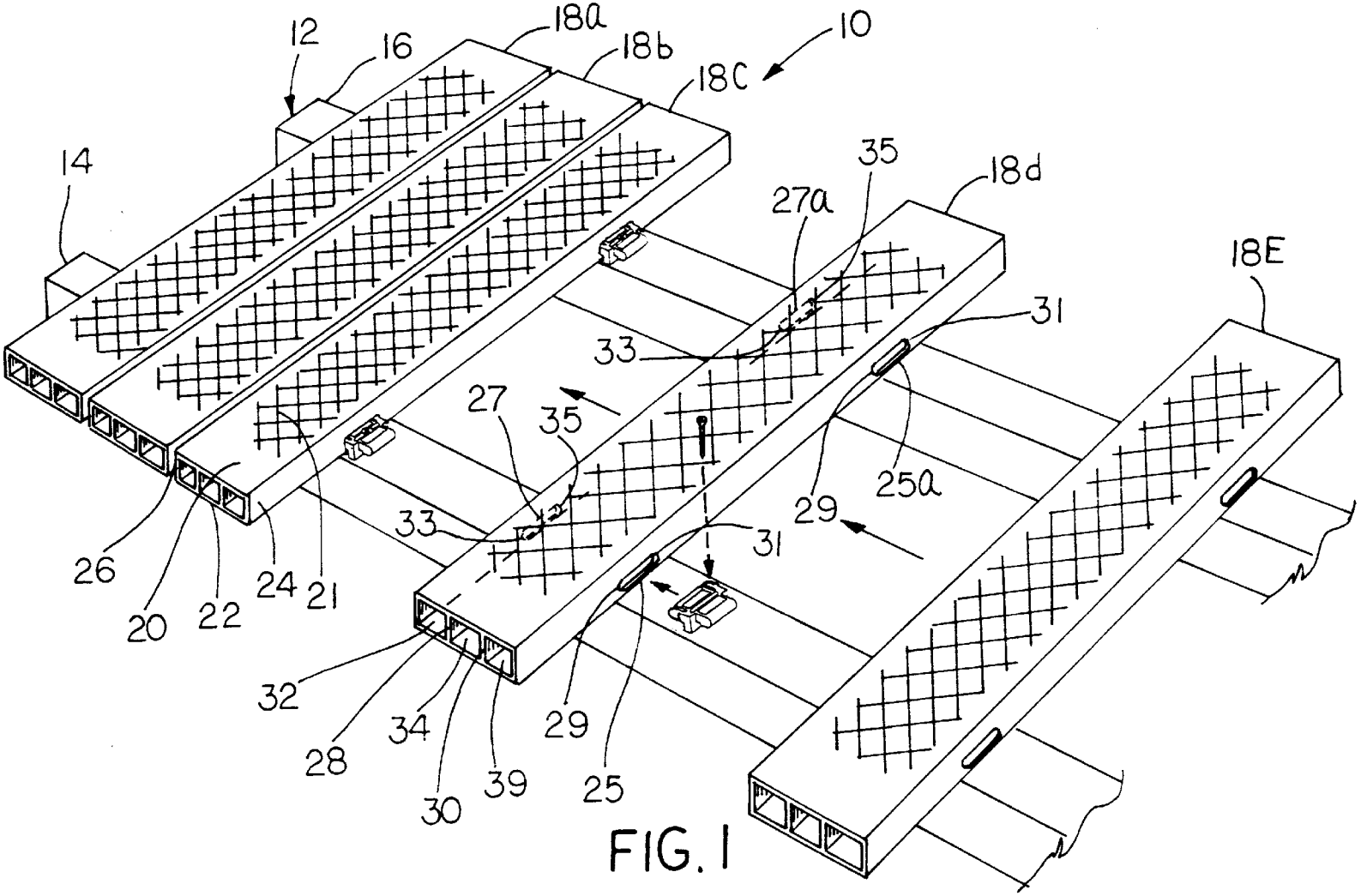
FIG. 1 is a perspective view of the polyvinyl deck system assembled according to the present invention, illustrating three deck members already installed over the supporting joists, and further illustrating the manner of placing the next members in position adjacent the installed members.

Referring now to the drawings, FIG. 1 shows a deck assembled according to the present invention generally indicated by the reference numeral 10 shown installed over frame 12 having a pair of joists 14, 16 as is common in the industry. Although in typical applications numerous joists are employed, for the sake of simplicity only two joists are shown. A plurality of deck members 18*a*, 18*b*, 18*c*, 18*d* and 18*e* are shown installed or ready to be installed on frame 12. In the embodiment shown, members 18*a–e* are shown installed perpendicular to joists 14, 16. Each deck member 18*a–e* includes top surface 20, bottom surface 22, first side surface 24 and second side surface 26. Members 18 are preferably formed of polyvinyl plastic. Although top surface 20 may be smooth, in the embodiment shown top surface 20 includes a plurality of grooves 21 which increase friction and improve traction. First side surface 24 includes a pair of slots 25, 25*a*, while second side surface 26 includes a plurality of slots 27, 27*a*. Slots 25, 25*a* each include a pair of ends 29, 31, while slots 27, 27*a* each include a pair of ends 33, 35. The spacing between slots 25 and 25*a*, and between slots 27 and 27*a* generally conforms to the spacing between the joists 14, 16. For the application shown wherein members 18*a–e* are perpendicular to joists 14, 16, slots 25 and 27 are directly opposite each other, as are slots 25*a* and 27*a*. However, in an application wherein members 18*a–e* are angled relative to joists 14, 16 (not shown) slots 25 and 27, as well as 25*a* and 27*a*, would be offset accordingly. A pair of internal reinforcing webs 28, 30 interconnect top surface 20 and bottom surface 22 along the length of member 18*a–e*, and thus define internal chambers 32, 34 and 39.

Figure 2:
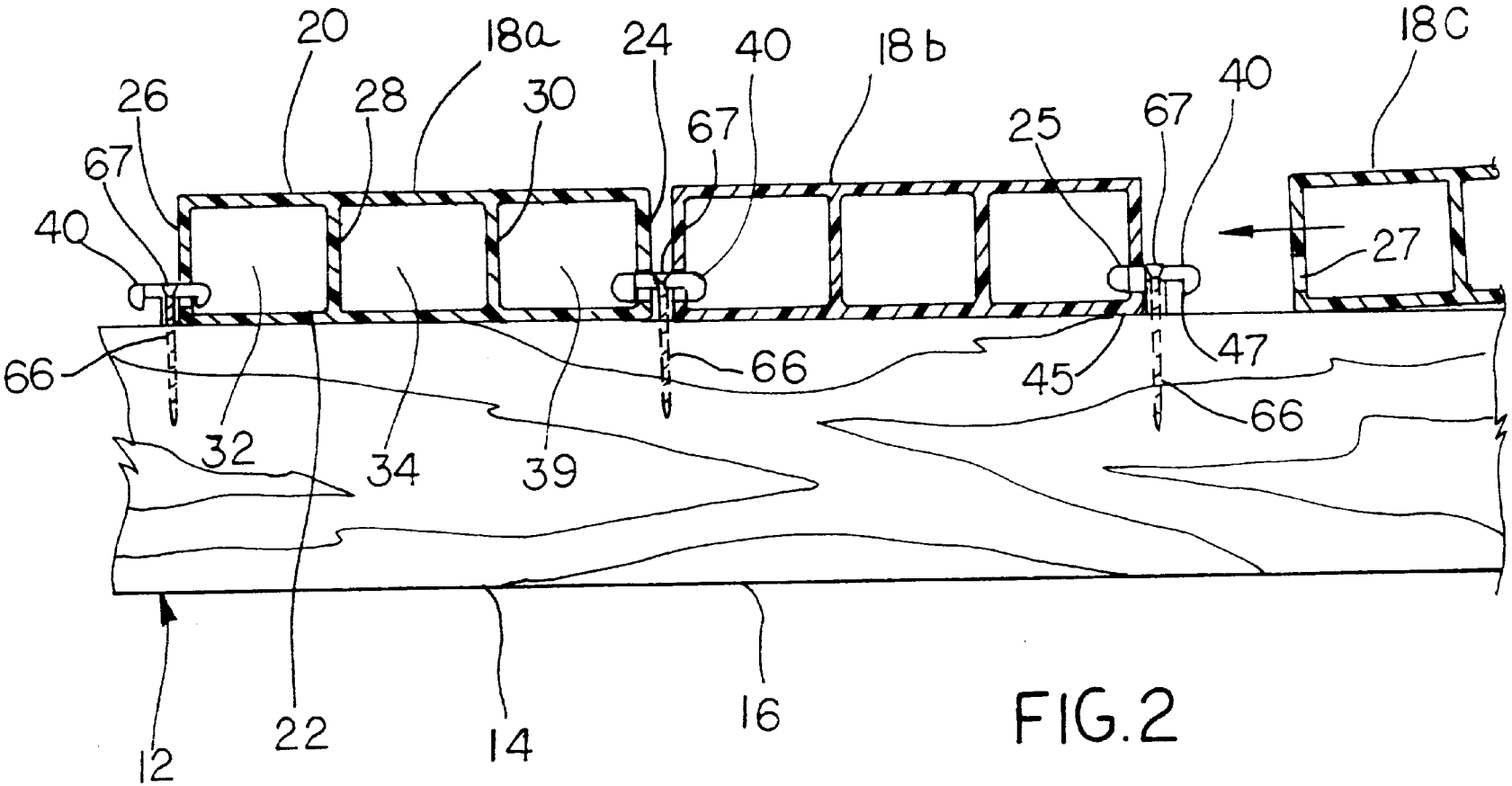
FIG. 2 is an enlarged fragmentary cross sectional view taken substantially along lines 2—2 of FIG. 1, illustrating the mounting cleats secured to the joists and engaging the one side of each member and also engaging the corresponding side of an adjacent member.
Figure 3:
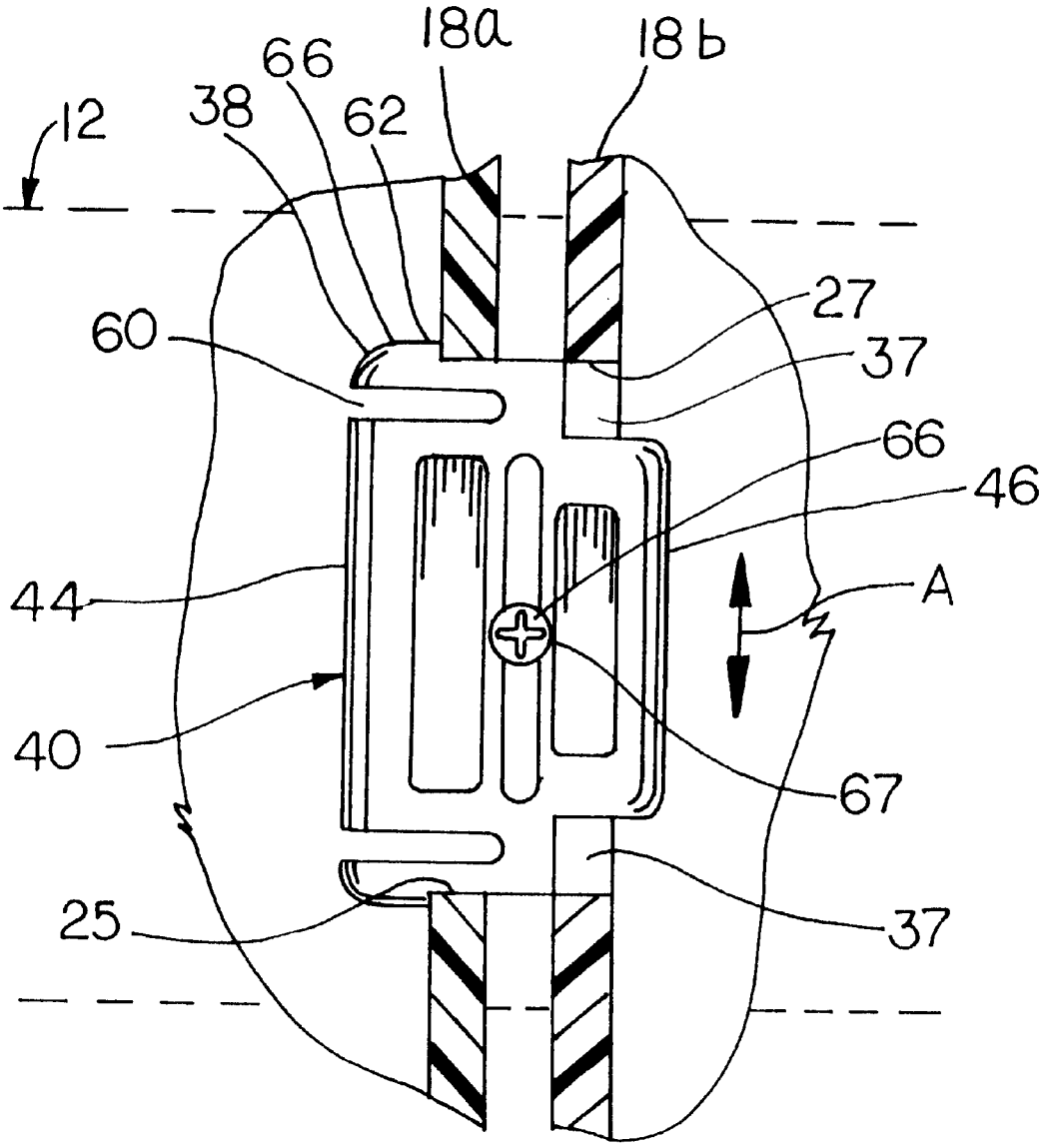
FIG. 3 is an enlarged top view of the mounting cleat used to secure the deck members to each other and to the supporting joists shown secured to the joist and engaging the slots in the members.
Figure 6:
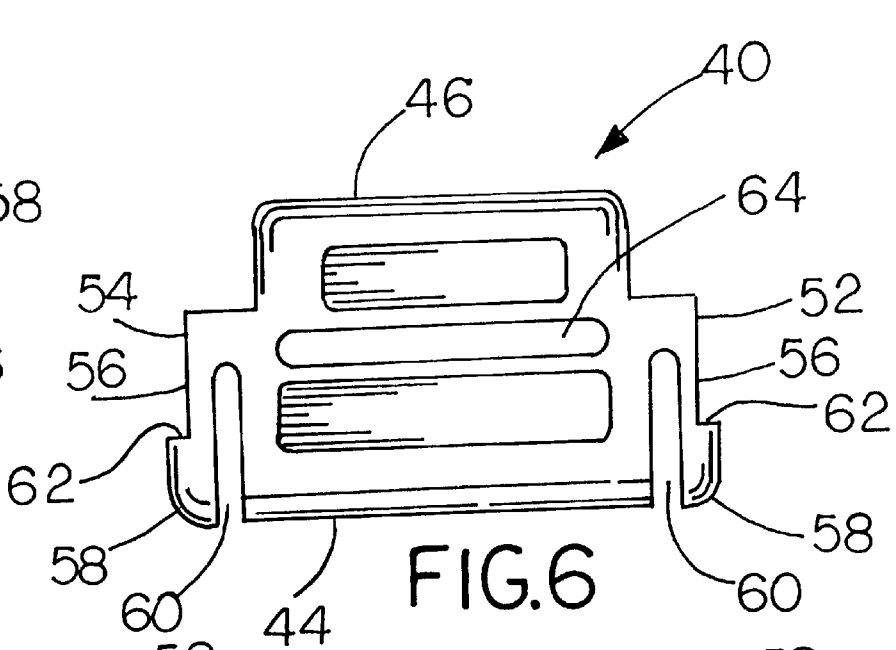
FIG. 6 is a top plan view of the mounting cleat shown in FIGS. 3 through 5.
Figure 7:
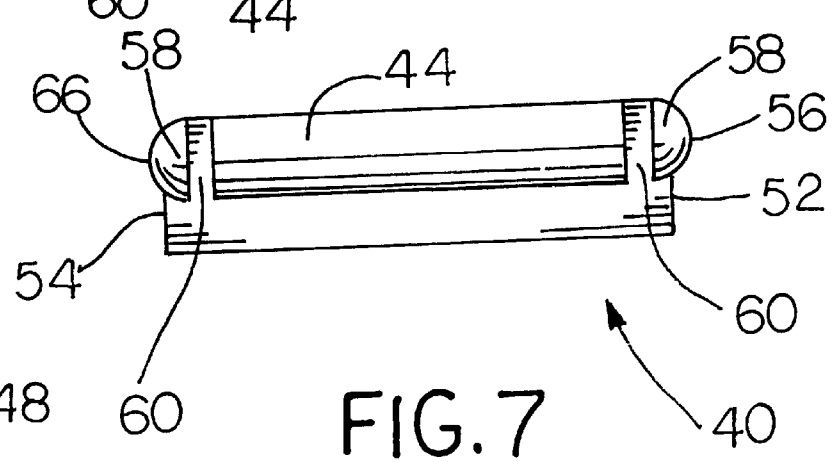
FIG. 7 is a side elevational view of the mounting cleat shown in FIGS. 3 through 6.
Figure 4:
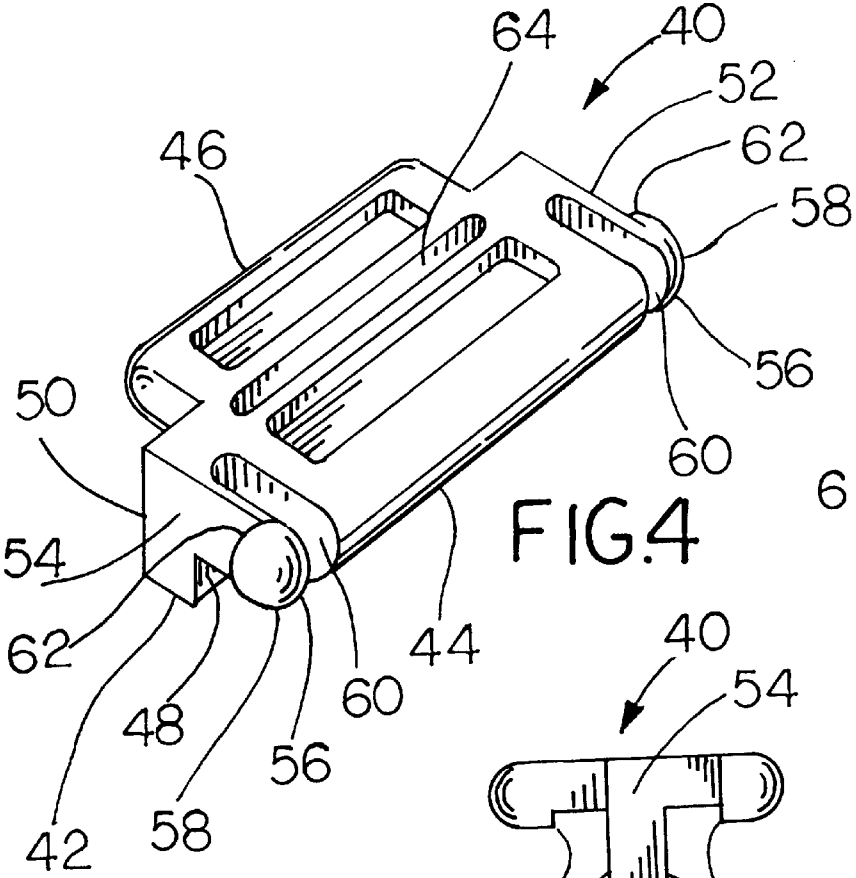
FIG. 4 is a perspective view of the mounting cleat shown in FIG. 3.
Figure 5:
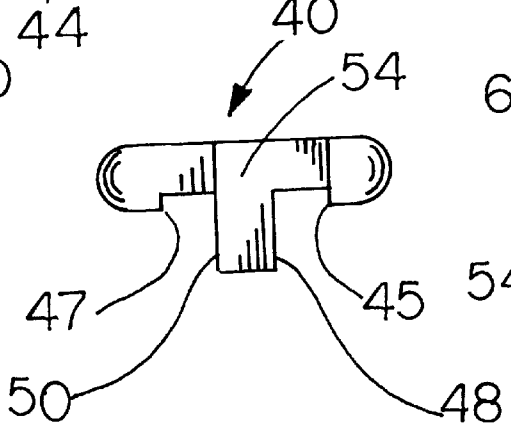
FIG. 5 is an end view of the mounting cleat shown in FIGS. 3 and 4.

Referring now to FIGS. 3 through 7, mounting cleat 40 includes central supporting portion 42 and first and second protrusions 44, 46, respectively, extending from central portion 42. Cleat 40 is preferably formed of hardened acetone, which eliminates squeaking that could normally occur due to slight movements between cleats 40 and members 18. Central portion 42 includes first and second shoulders 48, 50, respectively. First and second side surfaces 24, 26 abut shoulders 48, 50, respectively, thereby maintaining uniform spacing between adjacent members. Ends 52, 54 of first protrusion 44 each include an arm 56 defining a slotted aperture 60, and each arm 56 includes a rounded camming surface 58 and a retention surface 62. First protrusion 44 includes a downwardly extending lip 45, and second protrusion 46 includes a downwardly extending lip 47 as shown in FIGS. 2 and 5. Central portion 42 of cleat 40 further includes slot 64 for accommodating fastener 66 having head 67. The thickness of head 67 is less than the thickness of central portion 42 and wider than the thickness of slot 64, so that head 67 secures cleat 40 to frame 12 but does not affect the spacing between adjacent members. As shown in FIG. 3, slot 62 allows cleat 40 to move slightly relative to the joist during thermal expansion and retraction of the supporting frame 12 and/or the deck members 18 as shown by reference arrow A. Also shown in FIG. 3, the length of second protrusion 46 is shorter than protrusion 44 and also is shorter than the length of slots 27, 27*a*, leaving a gap 37 on each end of protrusion 46 and ends 33, 35 of slots 27, 27*a*. These gaps serve two purposes. First, they allow for the thermal expansion and contraction referred to above by preventing binding. Second, the gaps 37 provide the installer with more flexibility during installation to account for minor irregularities in the frame and/or the location of the slots. This added flexibility makes it easier to maintain the edges of the members in line and prevents the deck from "wandering" as installation progresses. When secured to one of the joists 14, 16, portion 42 engages the joists and supports protrusions 44, 46 above the joist a distance equal to the distance between bottom surface 22 and the lower edge of slots 25, 25*a* and 27, 27*a*.

In operation, a first deck member 18*a*, shown to the left in FIGS. 2 and 3, is installed over frame 12 by installing a cleat 40 in each of joists 14, 16 in the manner shown in FIG. 3 using a fastener 66 through slot 64. Member 18*a*, having a pair of cleats 40 already snapped into slots 25, 25*a* is then positioned over joists 14, 16 and pushed against the cleats 40 that have already been installed, so that the second side surface of member 18*a* abuts the second contact surface 50 of central portion 42, and second protrusion 46 of cleats 40 extend into slots 27 and 27*a*. Next, the cleats 40 on first side surface 24 are installed on joists 14, 16 by inserting fastener 66 through slot 64, thereby securing member 18*a* to the frame 12. Cleats 40 are connected to the first side surface 24 of each member 18 by inserting first protrusion 44 into slot 25 or 25*a*. Camming surfaces 58 contact ends 29, 31 of the slots, bending arms 56 until cleat 40 snaps into place, and retention surfaces 62 prevent cleats 40 from becoming disengaged from member 18 unless a great deal of force is applied. Member 18*b* is then positioned adjacent member 18*a* so that second side surface 26 contacts second abutment surface 50 of cleat 40 and second protrusion 46 protrudes into slots 27, 27*a*, and cleat 40 on first side surface 24 of member 18*b* is secured to frame 12 by inserting fasteners 66 through slot 64. The process is then repeated with each of members 18*c–e* until the entire deck is installed.

It will be appreciated that the foregoing is presented by way of illustration only, and not by way of any limitation, and that various alternatives and modifications may be made to the illustrated embodiment without departing from the spirit and scope of the invention.

What is claimed:

1. Decking system for placement on a frame, the frame having at least two spaced apart joists, said system comprising:

first and second elongated tubular members for placement generally adjacent each other and overlying and spanning the distance between the joists, each of said members having a top surface, a bottom surface engaging said joists, and first and second side surfaces connecting said top and bottom surfaces, each of said first and second side surfaces connecting said top and bottom surfaces, each of said first and second side surfaces including slots spaced to generally overlie the joists;

a mounting cleat including protrusions engaging said first side surface slots and said second side surface slots; and a fastener for securing said cleat to the joist thereby securing said first member first side surface and said second member second side surface to the joist;

said cleat including a central portion and first and second protrusions, said first protrusion for engaging a said first side surface slot and said second protrusion for engaging a said second side surface slot;

the length of said first protrusion matching the length of said first side surface slots, said first protrusion including a pair of arms for releasably locking said first protrusion in a said first side surface slot.

2. Decking system for placement on a frame, the frame having at least two spaced apart joists, said system comprising:

first and second elongated tubular members for placement generally adjacent each other and overlying and spanning the distance between the joists, each of said members having a top surface, a bottom surface engaging said joists, and first and second side surfaces connecting said top and bottom surfaces, each of said first and second side surfaces connecting said top and bottom surfaces, each of said first and second side surfaces including slots spaced to generally overlie the joists;

a mounting cleat including protrusions engaging said first side surface slots and said second side surface slots; and a fastener for securing said cleat to the joist thereby securing said first member first side surface and said second member second side surface to the joist;

the length of said first protrusion matching length of said first side surface slots, said first protrusion including a pair of arms for releasably locking said first protrusion in a said first side surface slot;

said central portion of said cleat including a slot for allowing each of said members to move slightly relative to the joists in a direction generally parallel to the longitudinal axis of said members yet preventing said members from moving in a direction generally perpendicular to said longitudinal axis.

3. The decking system of claim 2, wherein said slip means includes a slot in said central portion of said cleat, and further including a fastener sized to be received in said slot for securing said cleat to the joist yet permitting said cleat to move relative to the joist in a direction substantially parallel to the longitudinal axis of said members.

4. The decking system of claim 2, wherein the length of said second protrusion is shorter than the length of said second side surface slots thereby permitting said members to move relative to each other in a direction substantially parallel to the longitudinal axis of said members.

5. Decking system for placement on a frame comprising:

a plurality of elongated tubular members for placement generally adjacent each other and overlying the frame, each of said members having a top surface, a bottom surface engaging the frame, the first and second side surfaces interconnecting said top and bottom surfaces, each of said first and second side surfaces including slots spaced to generally overlie the frame;

a mounting cleat positioned between said members, said mounting cleat including slot engaging protrusions connectable to said first and second side surface slots on each of said members; and a fastener for attaching said cleat to the frame thereby securing said first member first side surface and said second members second side surface to the frame;

said cleat including a central portion and first and second protrusions, said first protrusion for engaging a said first side surface slot and said second protrusion for engaging a said second side surface slot;

the length of said first protrusion matching the length of said first side surface slots, said first protrusion including a pair of arms for releasably locking said first protrusion in a said first side surface slot.

6. The decking system of claim 5, wherein said central portion of said cleat abuts said first member first side surface and further abuts said second member second side surface, thereby maintaining substantially uniform spacing between adjacent members.

7. Decking system placement on a frame comprising:

a plurality of elongated tubular members for placement generally adjacent each other and overlying the frame, each of said members having a top surface, a bottom surface engaging the frame and first and second side surfaces interconnecting said top and bottom surfaces, each of said first and second side surfaces including slots spaced to generally overlie the frame;

a mounting cleat positioned between said members, said mounting cleat including a slot engaging protrusions connectable to said first and second side surface slots on each of said members; and a fastener for attaching said cleat to the frame thereby securing said first member first side surface and said second member second side surface to the frame;

said cleat including a central portion and first and second protrusions, said first protrusion for engaging a said first side surface slot and said second protrusion for engaging a said second side surface slot;

said central portion of said cleat including a slot for allowing each of said members to move slightly relative to the joists in a direction generally parallel to the longitudinal axis of said members yet preventing said members from moving in a direction generally perpendicular to said longitudinal axis.

8. The decking system of claim 7, wherein said slip means includes a slot in said central portion of said cleat, and further including a fastener sized to be received in said slot for securing said cleat to the joist yet permitting said cleat to move relative to the joist in a direction substantially parallel to the longitudinal axis of said members.

9. The decking system of claim 7, wherein the length of said second protrusion is shorter than the length of said second side surface slots thereby permitting said members to move relative to each other in a direction substantially parallel to the longitudinal axis of said members.

* * * * *